US005574423A

United States Patent [19]

Vosika et al.

[11] Patent Number: 5,574,423

[45] Date of Patent: Nov. 12, 1996

[54] SELF-DIAGNOSTIC CIRCUIT FOR EMERGENCY LAMPHEAD

[75] Inventors: David A. Vosika, Salem, Va.; Robert S. Feldstein, Dobbs Ferry, N.Y.

[73] Assignee: Hubbell Incorporated, Orange, Conn.

[21] Appl. No.: 402,056

[22] Filed: Mar. 10, 1995

[51] Int. Cl.[6] ..... G08B 1/00

[52] U.S. Cl. ..... 340/333; 340/642; 340/332; 340/514; 340/515; 362/20

[58] Field of Search ..... 340/514, 641, 340/642, 331, 332, 458, 693, 438; 362/20; 307/66

[56] References Cited

U.S. PATENT DOCUMENTS

| | | | |
|---|---|---|---|
| 4,223,232 | 9/1980 | Bulat | 362/20 |
| 4,447,806 | 5/1984 | Gündel et al. | 340/641 |
| 4,544,910 | 10/1985 | Hoberman | 340/333 |
| 4,667,187 | 5/1987 | Volk et al. | 340/641 |
| 4,799,039 | 1/1989 | Balcom et al. | 340/333 |
| 4,808,975 | 2/1989 | Hochhaus et al. | 340/641 |
| 5,145,504 | 9/1992 | Helal et al. | 362/20 |
| 5,148,158 | 9/1992 | Shah | 340/825 |

OTHER PUBLICATIONS

"Introducing the Factor–Hubbell's Self–Diagnostic System for the Pathfinder Series" (Apr. 1993).
"Spectron Series" (undated product information).
"hiQ Smarttest Self–Diagnostic Systems" (undated product information).
"Lightalarms Emergency Lighting Equipment" (undated product information).
"Advanced Emergency Lighting Technology" (undated product information).
"AtLite Emergency Lighting" (undated product information).
"High–Lites Emergency Light Options" (1992).
"Hubbell Lighting Inc.–Pathfinder Diagnostic Emergency Products" (undated product information).

*Primary Examiner*—Jeffery Hofsass
*Assistant Examiner*—Mohammed Ghannam
*Attorney, Agent, or Firm*—Jerry M. Presson; John E. Holmes

[57] ABSTRACT

A self-diagnostic circuit for an emergency lamphead is disclosed that is effective during standby operation of the lamphead to indicate whether the lamphead is capable of operating in an emergency mode. The self-diagnostic circuit includes a high-impedance circuit path connected in series with the lamphead and including an indicator, such as an LED, which is energized by a battery current passing through the circuit path and lamphead during the standby mode operation. The battery current is insufficient to illuminate the lamphead, but is sufficient to energize the LED whenever proper electrical continuity exists through the lamphead. A second high-impedance circuit path may be connected in parallel with the lamphead, in order to energize a second LED when proper continuity does not through the lamphead. The self-diagnostic circuit may be incorporated into each of a plurality of remote lampheads in a multiple-lamphead system, and may include a bipolar transistor or FET for isolating the self-diagnostic circuits of the lampheads from each other.

20 Claims, 4 Drawing Sheets

SELF-DIAGNOSTIC CIRCUIT FOR EMERGENCY LAMPHEAD

FIELD OF THE INVENTION

The present invention relates to a self-diagnostic circuit for use with an emergency lamphead. More specifically, the invention relates to a self-diagnostic circuit which is effective during standby operation of an emergency lamphead to indicate whether the lamphead is capable of operating in an emergency mode.

BACKGROUND OF THE INVENTION

Emergency lighting systems are used in many types of facilities to provide DC battery-powered lighting during periods when the main AC power supply has become temporarily inoperative for some reason. Examples of such facilities include schools, hospitals, government offices, hotels and motels, industrial buildings, multi-unit dwellings, shopping malls, and airports. In many cases, these structures are very large and require that emergency lampheads be placed at several different locations to provide adequate coverage. Fire safety codes require that emergency lighting systems be tested periodically to ensure that they will operate properly during an emergency. With a system employing many separate lampheads at scattered locations, these tests can be laborious and time-consuming to perform. For this reason, various types of self-diagnostic systems have been developed to facilitate the testing procedure.

A typical emergency lighting system consists of a battery for supplying power to one or more lampheads during an AC power loss, a charger for charging the battery from the AC power supply during standby operation, and a relay or other type of switching device for connecting the lampheads to the battery when an AC power loss is detected. When a self-diagnostic system is provided, it generally operates by briefly simulating an AC power outage and checking to be sure that the emergency lampheads illuminate properly. The test may be initiated manually, by depressing a pushbutton or operating a remote control device, or automatically in response to an internal timer. In some cases, an internal control system (such as a microprocessor) automatically carries out a number of different tests in sequence, such as tests for lamp current flow, power transfer from charger to battery, and battery voltage. If one or more of these tests fails, a light-emitting diode (LED) or other type of visual indicator may be illuminated to indicate that maintenance is required. In more sophisticated systems employing central computer monitoring, an indication of test failure may also be produced on a computer display terminal at a central monitoring location.

In some emergency lamphead systems, the battery and charging circuitry are housed in a separate unit which is remote from some or all of the lampheads to which it is connected. When self-diagnostic circuitry is provided, it will ordinarily be located in the central unit rather than in the remote lampheads. This facilitates testing for proper battery and charger operation, but makes it difficult to check for proper operation of the individual lampheads. Problems which can render an individual lamphead inoperable include a defective, burned out or improperly connected lamp, or a wiring problem at the lamphead. Most of these problems can be detected by checking for proper electrical continuity through each lamphead, but this is difficult to accomplish from a central location. The remote lampheads are typically connected to each other and to the central battery and charging unit in a parallel "daisy chain" arrangement, and hence a self-diagnostic circuit located at the central unit cannot perform separate tests on each lamphead to identify a specific lamphead that requires service. Typically, therefore, a central monitoring or diagnostic circuit shows that one of the lampheads is not operating for some reason, but does not specify the identity or location of the inoperative lamphead. It then becomes necessary to place the entire system into emergency mode operation in order to visually identify the lamphead which is not operating.

The problem of checking for proper electrical continuity at remote lampheads is more difficult to solve than might be expected. There is a need to minimize the number of lines or connections between the remote lampheads and the central unit; therefore, the solution does not lie in running a large number of additional wires between the remote lampheads and the central unit to support diagnostic functions. Conversely, the expense and complexity of the self-diagnostic circuitry is ordinarily such that it is not practical to provide the circuitry at each remote lamphead location. Even if this were attempted, the "daisy chain"connections between remote lampheads would give rise to the additional problem of maintaining proper isolation between the self-diagnostic circuits of the individual lampheads, so that the output of each diagnostic circuit will reflect the condition of its associated lamphead without being affected by the condition of other lampheads.

SUMMARY OF THE INVENTION

A primary object of the present invention is to provide an emergency lamphead self-diagnostic circuit which is simple and inexpensive in construction, and which can be cost-effectively integrated into each of a plurality of remote lampheads in a multiple-lamphead emergency lighting system.

A further object of the invention is to provide an emergency lamphead self-diagnostic circuit which can operate continuously rather than only during periodic testing cycles, so that component failures can be detected immediately.

A further object of the invention is to provide an emergency lamphead self-diagnostic circuit which is compatible with existing types of emergency lighting systems, including those already incorporating other types of diagnostic or monitoring systems.

Still another object of the present invention is to provide an emergency lamphead self-diagnostic circuit which allows a number of remote lampheads to be connected to each other and to a central unit, using a minimum number of wires.

Still another object of the present invention is to provide an emergency lamphead self-diagnostic circuit which can be incorporated into each of a plurality of interconnected remote lampheads, while maintaining proper isolation between the diagnostic circuits of the individual lampheads.

The foregoing objects are substantially achieved by providing a emergency lamphead system which comprises at least one emergency lamphead, a battery for supplying power to the emergency lamphead during operation in an emergency mode, a charger for charging the battery during operation in a standby mode, a transfer switch for switching the output of the to the battery lamphead for operation in the emergency mode, and a self-diagnostic circuit connected to the battery and the lamphead for indicating during standby mode operation whether the lamphead is capable of operating in the emergency mode. The self-diagnostic circuit includes a high-impedance circuit path which is connected in series with the lamphead. The high-impedance circuit path includes an indicator which is energized by a battery current passing through the circuit path and the lamphead during operation in the standby mode. The battery current passing through the high-impedance circuit path is insufficient to illuminate the lamphead, but is sufficient to energize the indicator whenever proper electrical continuity exists through the lamphead.

In a preferred embodiment of the invention, the self-diagnostic circuit further comprises a second high-impedance circuit path connected in parallel with the lamphead. The second high-impedance circuit includes a second indicator which is energized by a second battery current passing through the second high-impedance circuit path to indicate that the emergency lamphead is not capable of operating in the emergency mode. The flow of battery current in the second high-impedance path is disabled in response to the flow of current in the first high-impedance circuit path, so that the second indicator is de-energized whenever the first indicator is energized. The first and second indicators may, for example, comprise green and red light-emitting diodes (LEDs) which are mounted on the exterior of the emergency lamphead housing.

In accordance with another aspect of the present invention, a self-diagnostic circuit is provided for use with an emergency lamphead system including at least one emergency lamphead, a battery for supplying power to the emergency lamphead in an emergency mode, a charger for charging the battery in a standby mode, and a transfer switch for switching one polarity output of the battery to the lamphead in the emergency mode. The self-diagnostic circuit comprises a first input terminal adapted to be connected to a first polarity output of the battery, a second input terminal to be adapted to be connected to a second polarity output of the battery through the transfer switch, a third input terminal adapted to be connected to the second polarity output of the battery without passing through the transfer switch, first and second output terminals adapted to be connected to the power terminals of the emergency lamphead, with the first output terminal being coupled to the first input terminal, and a controlled switching device coupled between the second output terminal and the second input terminal. The controlled switching device is rendered conductive to energize the output terminals in response to battery voltage being applied between the first and second input terminals by the transfer switch in the emergency mode, and is rendered nonconductive to de-energize the output terminals in response to the battery voltage being removed from the second input terminal by the transfer switch in the standby mode. A high-impedance circuit path extends between the second output terminal and the third input terminal, and includes an indicator which is energized by a battery current passing through the high-impedance circuit path and the emergency lamphead in the standby mode to indicate that the emergency lamphead is capable of operating. The impedance of the high-impedance circuit path is high enough so that the battery current is insufficient to illuminate the emergency lamphead in the standby mode, but is sufficient to energize the indicator whenever proper electrical continuity exists through the emergency lamphead.

In a preferred embodiment of the invention, a second high-impedance circuit path is provided between the first and third input terminals, and includes a second indicator which is energized by a battery current passing through the second high-impedance circuit path to indicate that the emergency lamphead is not capable of operating. The flow of battery current in the second high-impedance circuit path is disabled by the flow of battery current in the first high-impedance circuit path, so that the second indicator is de-energized whenever the first indicator is energized. The first and second indicators may comprise LEDs of different colors mounted to the exterior of the emergency lamphead housing, as described previously.

The present invention is also directed to a method for monitoring the operational status of an emergency lamphead. The method comprises the steps of placing the lamphead in series with a first indicator circuit which produces an output in response to a flow of current through the first indicator circuit; applying a voltage across the series combination of the lamphead and the first indicator circuit to produce a flow of current through the first indicator circuit when electrical continuity exists through the lamphead; and limiting the current to a value sufficient to produce an output from the first indicator circuit but insufficient to illuminate the lamphead. In a preferred embodiment of the invention, the method also comprises the steps of placing a second indicator circuit in parallel across the series combination of the lamphead and the first indicator circuit, with the second indicator circuit producing an output in response to a flow of current through the second indicator circuit; and, in the absence of electrical continuity through the lamphead, causing current to flow through the second indicator circuit as a result of the applied voltage to produce an output from the second indicator circuit.

BRIEF DESCRIPTION OF THE DRAWINGS

Referring now to the drawings, which form a part of the original disclosure.

Throughout the drawings, like reference numerals will be understood to refer to like parts and components.

DETAILED DESCRIPTION OF THE PREFERRED EMBODIMENTS

Figure 1:
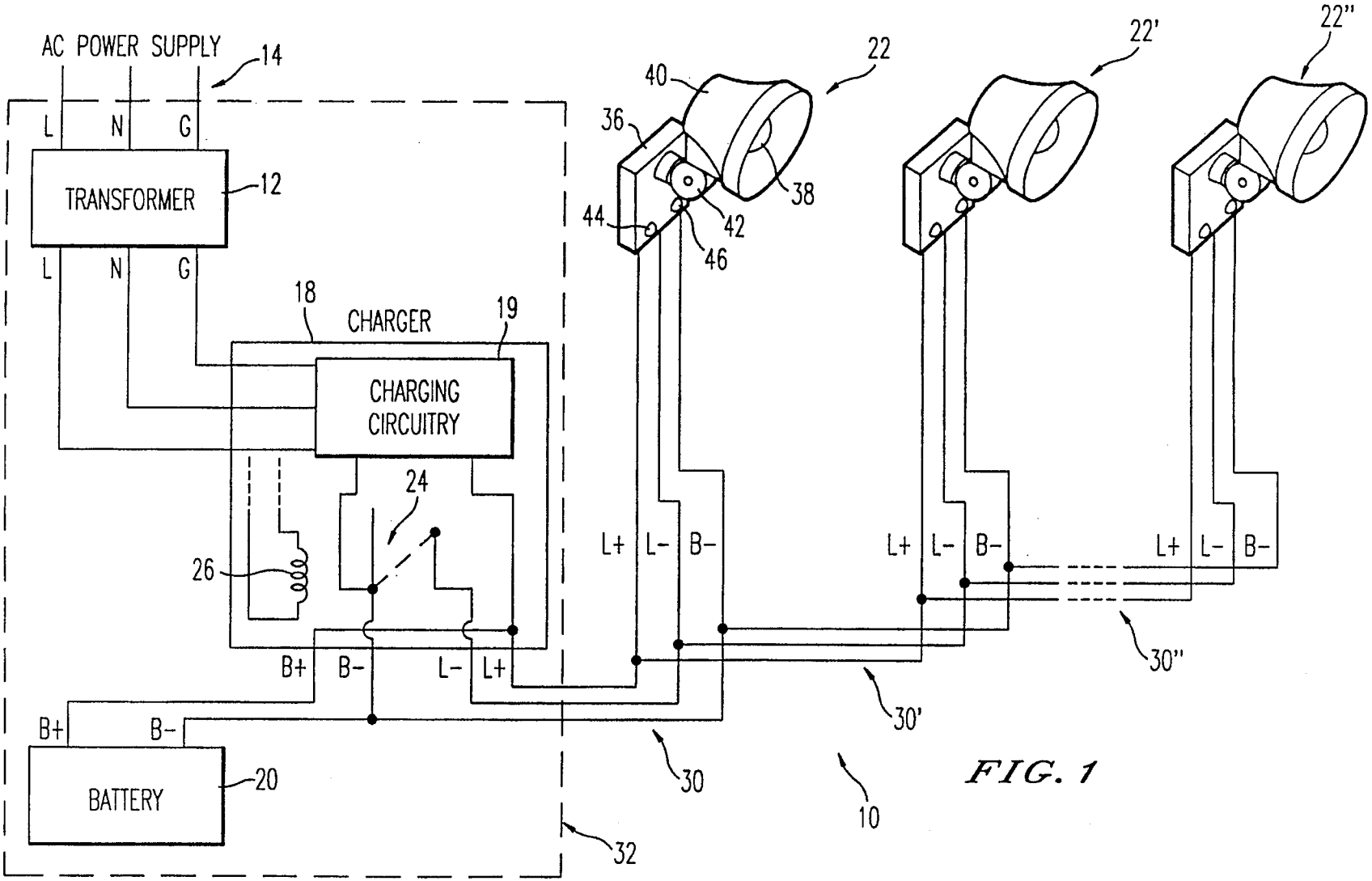
FIG. 1 is a block diagram of an emergency lighting system employing remote lampheads that incorporate self-diagnostic circuits in accordance with the present invention.

An emergency lighting system 10 in accordance with a preferred embodiment of the present invention is illustrated in FIG. 1. The system 10 includes a power supply transformer 12 which is connected to an incoming AC power supply, 14 typically ranging from 120 to 347 volts AC at 50 or 60 Hz. The transformer 12 steps down the incoming AC voltage to a level that is suitable as an input to a battery charger 18. The charger 18 is of a conventional type and includes DC rectifying and voltage regulating circuitry 19 for maintaining a battery 20 in a fully charged condition. The charger 18 has four output terminals which are designated B+, B–, L– and L+, respectively. The B+ and B– terminals are the battery terminals of the charger 18 and are connected to the positive and negative terminals of the battery 20, respectively. The L– and L+ terminals are the lamp output terminals of the charger 18 and are connected in a parallel "daisy chain" arrangement, as shown, to the power terminals of a plurality of remote lampheads 22, 22' and 22". For the purposes of the present invention, the B– terminals of the charger 18 and battery 20 are also connected to each of the remote lampheads 22, 22' and 22" in the same manner. Thus, each lamphead has three input terminals L+, L– and B–. The terminals L+ and L– are the power input terminals for operating the lamphead in the emergency mode, and the terminal B– is an additional power input terminal for operating the self-diagnostic circuitry of the lamphead during standby operation, as will be described shortly.

In order to switch between standby and emergency mode operation, the charger 18 includes an internal relay 24 whose coil 26 is coupled to a transistor (not shown) that senses the potential across the line (L) and neutral (N) outputs of the transformer 12. When AC power is available from the incoming power supply 14, the relay contacts are held in the unswitched (open) position as shown in solid outline in FIG. 1. In this condition, the lamp terminal L– is open-circuited and the lampheads 22, 22' and 22" are therefore maintained in the standby or non-illuminated mode. The charging circuitry (not shown) within the charger 18 maintains the battery 20 in a fully charged condition during the standby mode. When the AC power from the incoming supply 14 is interrupted or falls below a predetermined level, the transistor energizes the relay coil 26 and causes the relay contacts to move to the switched (closed) position as shown in phantom in FIG. 1. In this position, the relay contacts connect the terminals B+ and B– of the battery 20 to the lamp output terminals L+ and L–, respectively, in order to illuminate the remote lampheads 22, 22' and 22". Thus, the relay 24 serves as a transfer switch for automatically initiating emergency mode operation in the event of a power supply interruption, and for automatically returning the system 10 to standby operation once power has been restored. In practice, the relay 24 switches only the negative (B–) terminal of the battery 20 between the charging circuitry and the negative (L–) output of the charger 18, as shown, and the positive (B+) terminal of the battery 20 is permanently wired to the positive (L+) lamp output of the charger 18. However, it is also possible to use the relay 24 to switch the positive (B+) terminal of the battery 20 to the positive (L+) lamp output of the charger 18. As another modification, it is possible to use a power transistor in lieu of the relay 24 to isolate the battery 20 from the lamp terminal L– or L+ during standby mode operation.

The transformer 12, charger 18 and battery 20 are preferably housed in a single central unit 32 which is connected by means of wire runs 30, 30' and 30" to the remote lampheads 22, 22' and 22". The lampheads 22, 22' and 22" may be placed at various locations throughout a building or other structure to provide emergency lighting wherever needed. Any desired number of lampheads 22, 22' and 22" may be connected to the central unit 32, subject to the current rating of the battery 20. An example of a commercially available battery and charging assembly that may be used as the central unit 32 is the Model HP12100 emergency charger manufactured by Hubbell Lighting, Inc., of Christianburg, Va., which switches the lamp output on the positive leg of the battery, or the Hubbell Lighting Model PE612 emergency unit, which switches the lamp output on the negative leg of the battery.

As illustrated in FIG. 1, all of the remote lampheads 22, 22' and 22" may be essentially identical in construction. Referring to the remote lamphead 22 for convenience, the lamphead will be seen to include a small housing 36 which serves the dual purpose of providing a mounting or attachment point for securing the lamphead to a shelf or wall, and enclosing a self-diagnostic circuit to be described shortly. The housing 36 carries an emergency lamp 38 and lamp enclosure 40 by means of a two-axis rotatable Joint 42, which allows the lamp 38 and enclosure 40 to be aimed or pointed in the desired direction. On the front panel of the housing 36 are two light-emitting diodes (LEDs) 44 and 46 which serve as the output of the self-diagnostic circuit of the lamphead 22. The left-hand LED 44 is preferably green in color and, when illuminated, indicates that proper electrical continuity exists in the lamphead 22. The right-hand LED 46 is preferably red in color and, when illuminated, indicates that proper continuity does not exist through the lamphead 22. Lack of continuity may result from several factors, including a burned out, defective or improperly installed lamp 38 or improper or defective wiring in the lamphead 22. As will be described below, the self-diagnostic circuit is capable of operating continuously during standby operation of the emergency lighting system 10, and hence the LEDs 44 and 46 will provide a continuous indication of the status of the lamphead 22.

Figure 2:
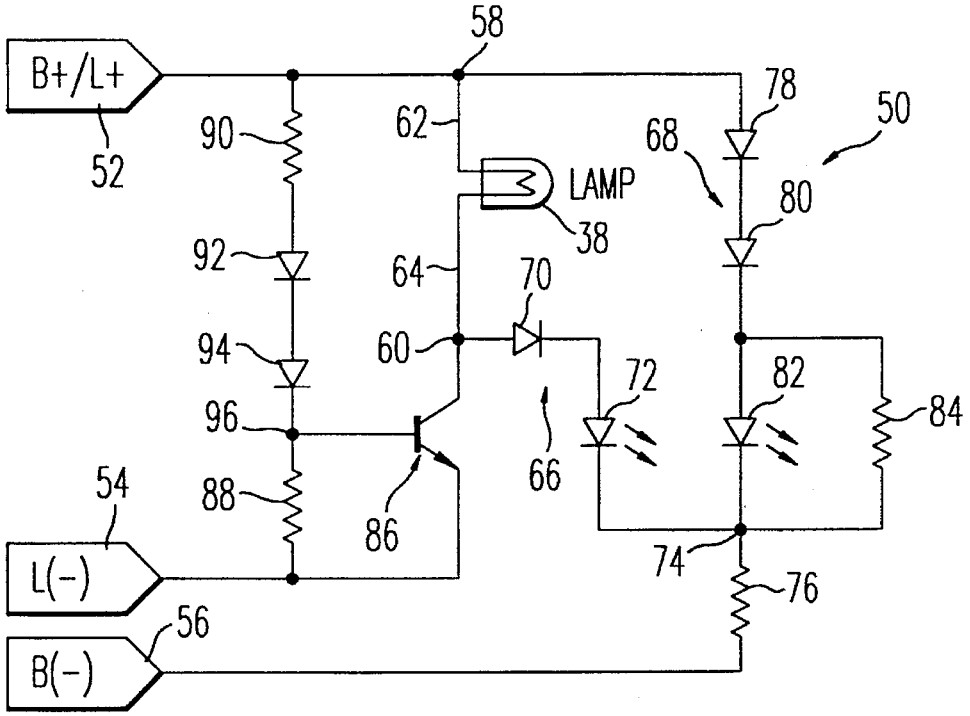
FIG. 2 is a detailed schematic diagram of a preferred self-diagnostic circuit which may be incorporated into each of the remote lampheads of FIG. 1, with a bipolar transistor used for isolating the lampheads from each other.

A detailed schematic diagram of a preferred self-diagnostic circuit 50 which may be incorporated into each of the emergency lampheads 22, 22' and 22" of FIG. 1 is illustrated in FIG. 2. The self-diagnostic circuit includes a first input terminal 52 which is connected to the L+ output of the charger 18 in FIG. 1 (as previously noted, this terminal is permanently wired to the B+ terminal of the battery 20). The circuit 50 also includes a second input terminal 54 which is connected to the L– output of the charger 18. During standby operation of the emergency lighting system 10, the relay 24 of FIG. 1 maintains the input terminal 54 in a open-circuit condition; however, during emergency mode operation, the relay 24 connects the input terminal 54 to the B– terminal of the battery 20. A third input terminal of the self-diagnostic circuit 50, indicated at 56 in FIG. 2, is connected directly to the B– terminal of the battery 20 without passing through the contacts of the relay 24. Thus, a voltage is present between the third input terminal 56 and the first input terminal 52 during standby operation of the emergency lighting system, and this provides power for the operation of the self-diagnostic circuit 50.

The self-diagnostic circuit 50 also includes first and second output terminals 58 and 60, respectively. The first output terminal 58 is connected directly to the first input terminal 52, as shown. The output terminals 58 and 60 are connected to the lamp leads 62 and 64, respectively, of the emergency lamphead circuit. For the purposes of illustration, the emergency lamphead circuit is illustrated in FIG. 2 as including only the lamp 38. In reality, however, the lamphead circuit will also include the lamp socket and its associated wiring. By connecting the output terminals 58 and 60 of the self-diagnostic circuit 50 across the entire lamphead circuit, lack of electrical continuity at any point in the lamphead circuit can be detected.

The self-diagnostic circuit 50 includes two high-impedance circuit paths 66 and 68, with the first high-impedance circuit path being connected in series with the lamphead circuit and the second high-impedance circuit path 68 being connected in parallel with the lamphead circuit. The first high-impedance circuit path 66 includes a silicon junction diode 70 and a green LED 72 connected in series (and in the same polarity orientation) between the output terminal 60 and a common node 74. A resistor 76 is connected between the common node 74 and the third input terminal 56 to provide the circuit path 66 with the desired impedance. Preferably, the resistor 76 has an impedance with is much higher (e.g., by two orders of magnitude or more) than the impedance of the lamp 38 and associated lamphead circuitry. Thus, for example, a lamphead circuit utilizing a 6-volt, 25-watt lamp 38 will have a cold DC resistance or impedance value of approximately 0.5 ohms and a hot DC resistance or impedance value of approximately 1.5 ohms. In this example, a resistor 76 having a value of 390 ohms may be utilized. The resistance value is chosen so that current flow and power dissipation in the high-impedance circuit path 66 will be minimized, with the current held to a value insufficient to illuminate the lamp 38. At the same time, however, the voltage and current applied to the LED 72 are sufficient to illuminate the LED when continuity exists through the lamphead circuit.

The second high-impedance circuit path 68 is connected in parallel across the lamphead circuit and includes two silicon junction diodes 78 and 80 and a red LED 82, all connected in series (and in the same polarity orientation) between the first input terminal 52 and the common node 74. A bypass resistor 84 is connected in parallel across the LED 82. The resistor 76 connected between the common node 74 and the third input terminal 56 is shared with the first high-impedance circuit path 66 and provides the second high-impedance circuit path 68 with an equivalent resistance. As in the case of the first high-impedance circuit path 66, the resistor 76 limits current flow and power dissipation in the second high-impedance circuit path 68 under conditions when the red LED 82 is illuminated.

The self-diagnostic circuit 50 also includes a bipolar NPN transistor 86 which has its collector connected to the second output terminal 60 and its emitter connected to the second input terminal 54. A leakage bypass resistor 88 is connected between the base of the transistor and the second input terminal 54. A biasing resistor 90 and two diodes 92 and 94 of the same polarity are connected in series between the first input terminal 52 and the node 96 between the resistor 88 and the base of the transistor 86. In this way, base drive is provided to the transistor 86 when a sufficient voltage appears between the first and second input terminals 52 and 54. When the transistor is conducting, current is allowed to pass between the collector and emitter of the transistor 86, thereby illuminating the emergency lamp 38. The transistor 86 serves as a controlled switching device for providing isolation between the self-diagnostic circuit 50 and the self-diagnostic circuits of other connected lampheads, as will be explained in more detail shortly. The current conduction capability of the transistor 86 is sufficient to handle the current drawn by the lamp 38 when the latter is in its energized or illuminated condition.

The operation of the self-diagnostic circuit 50 of FIG. 2 will be evident from the foregoing description. During standby operation of the emergency lighting system 10, battery voltage is provided between the first and third input terminals 52 and 56, respectively, but the second input terminal 54 is open-circuited. In this condition, no current flows through the circuit path consisting of the resistors 88 and 90 and diodes 92 and 94, and hence no base drive is provided to the transistor 86. The transistor 86 is thus maintained in a nonconducting (cutoff) state. At the same time, however, the output voltage of the battery 20 in FIG. 1 is applied across the first and third input terminals 52 and 56, and (assuming proper lamphead continuity) this results in voltages being applied across both the first and second high-impedance circuit paths 66 and 68. The resulting current in the first high-impedance circuit path 66 illuminates the green LED 72, indicating that proper continuity exists through the lamp 38 and associated lamphead circuitry. As is known, the voltage drop across a silicon junction diode in the conducting state is approximately 0.7 volt, while the voltage drop across an LED in the conducting state is approximately 2 volts. Thus, assuming for the purpose of example that the battery 20 of FIG. 1 produces an output of 6.8 volts at full charge, the aggregate voltage drop across the series connected diode 70 and green LED 72 in the first-high impedance circuit path 66 will be approximately 2.7 volts. This leaves approximately 4 volts to be divided between the lamp 38 (and associated lamphead circuitry) and the resistor 76. Because the impedance of the resistor 76 is much greater than that of the lamphead, virtually all of this voltage will appear across the resistor 76. It follows that, in the case of the second high-impedance circuit path 68, there is only approximately 2.7 volts to be divided among the diodes 78 and 80 and red LED 82. This potential is insufficient to place all three devices into conduction. The resulting non-illuminated condition of the red LED 82 provides an additional indication that proper continuity exists through the lamphead 22. The bypass resistor 84 prevents any illumination of the LED 82 from the very small current passing through the second high-impedance circuit path 68.

Let is now be assumed that the emergency lighting system is still operating in a standby condition, but that proper electrical continuity does not exist through the lamphead 22 due to a burned-out bulb 38 or one of the other conditions mentioned earlier. In this situation, no current can flow through the first high-impedance circuit path 66, and hence the green LED 72 is no longer illuminated. This provides an indication that a problem exists at the lamphead 22 requiring service. With the first high-impedance circuit path 66 no longer conducting, the voltage across the resistor 76 is no longer held at 4 volts and can transition to a lower value. With a battery voltage of 6.8 volts applied across the first and third input terminals 52 and 56, the diodes 78 and 80 and red LED 82 of the second high-impedance circuit path will produce an aggregate voltage drop of approximately 3.4 volts, leaving approximately 3.4 volts across the resistor 76. The diodes 78 and 80 and red LED 82 are now in conduction, and the illuminated condition of the red LED 82 (together with the non-illuminated condition of the green LED 72) indicates that proper electrical continuity does not exist in the lamphead 22. This provides a warning to maintenance personnel that the lamphead 22 is not capable of operating in the emergency mode, and that bulb replacement or other service is required.

As noted previously, emergency mode operation is initiated at the charger 18 of FIG. 1 by connecting the B– battery terminal to the L– lamp output terminal. This has the effect, in the self-diagnostic circuit 50 of FIG. 2, of electrically coupling the second and third input terminals 54 and 56 to each other and thereby placing the transistor 86 into saturation. With the transistor 86 conducting, the first high-impedance circuit path 66 is bypassed and the green LED 72, if previously illuminated, is now extinguished. Thus, during emergency mode operation, the bulb 38 of a functioning lamphead will be illuminated but the green LED 72 will not. However, whether or not the red LED 82 was illuminated prior to the initiation of emergency mode operation (indicating a burned-out bulb 38 or other problem in the lamphead), it will be illuminated for the duration of the emergency. This is a result of the fact that the second high-impedance circuit path 68 is connected across the battery terminals, and hence receives battery voltage even when an open circuit condition exists within the lamphead. The illumination of the red LED 82 indicates that emergency mode operation is in effect and provides a positive indication that battery voltage is available at the lamphead. Thus, the user is alerted that any failure of the lamp 38 to illuminate is due to a bulb failure or other problem at the lamphead itself, rather than to a defect in the wiring leading to the lamphead.

The bipolar transistor 86 in the self-diagnostic circuit 50 of FIG. 2 provides isolation between different lampheads when a plurality of lampheads 22, 22' and 22" are connected together in a parallel "daisy chain" arrangement as illustrated in FIG. 1. In the absence of the transistor 86, a common path would exist through the second input terminals 54 of the lampheads and would allow the green LED 72 of a given lamphead to be illuminated even when proper continuity does not exist through that particular lamphead due to a burned-out bulb 38 or other problem. When the transistor 86 is in saturation, the voltage drop between its collector and emitter is negligible (about 0.1 volt), and hence the light output of the lamphead 22 in the emergency mode is not significantly affected. It will also be appreciated that the operation of the self-diagnostic circuit 50 of FIG. 2 is essentially transparent from the standpoint of the first and second input terminals 52 and 54; that is, the lamphead circuit behaves in essentially the same manner (in terms of voltage and current characteristics) whether or not the self-diagnostic circuit is connected. The only differences are a slight increase in emergency mode current attributable to the base circuit of the transistor 86, and an added voltage drop attributable to the collector-to-emitter voltage across the transistor. Both of these factors can be minimized by appropriate choice of the transistor 86. It will be appreciated that the "transparency" of the self-diagnostic circuit 50 is advantageous in that it allows a lamphead incorporating the self-diagnostic circuit to be used with existing types of chargers 18 or central units 32 (including those incorporating other types of diagnostic and self-testing circuits) without requiring any special modifications.

As will be evident from the foregoing description of the self-diagnostic circuit 50, the alternative operation of the green and red LEDs 72 and 82 arises from the fact that the aggregate diode voltage drop in the second high-impedance circuit path 68 is greater than that in the first high-impedance circuit path 66. In the illustrated embodiment, this results from the use of two series-connected diodes 78 and 80 in the second high-impedance circuit path 68 and one diode 70 in the first high-impedance circuit path 66, as shown. However, the same result may be obtained by increasing the number of diodes in each circuit path while maintaining the total number of diodes in the circuit path 68 at least one greater than the total number of diodes in the circuit path 66. It is also possible to reduce the number of diodes in each of the circuit paths 66 and 68 by one, but this would subject the LED 72 to reverse bias potentials that may be damaging over time. The connection of the bypass resistor 84 in parallel across the red LED 82 prevents the red LED from glowing when the green LED 72 is illuminated, by bypassing any current that may occur through the diodes 78 and 80.

Figure 3:
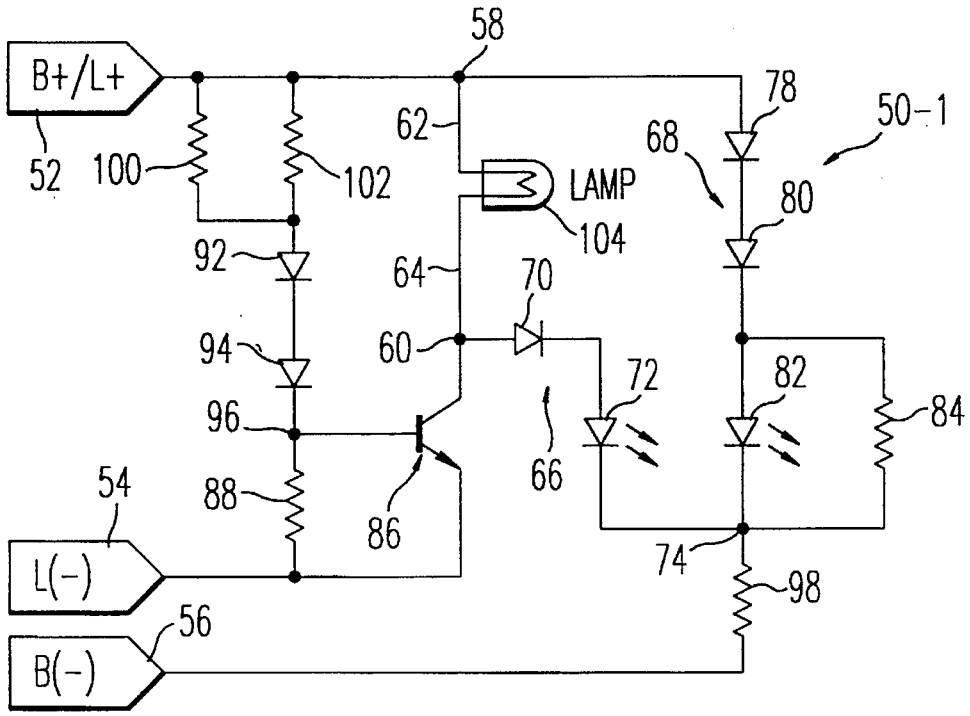
FIG. 3 is a detailed schematic diagram of a modified version of the self-diagnostic circuit of FIG. 2, adapted for operation at a higher battery voltage.

FIG. 3 illustrates a modified version 50-1 of the self-diagnostic circuit 50 of FIG. 2 which is adapted for 12-volt rather than 6-volt operation. Most of the circuit components are identical and have been designated by corresponding reference numerals. However, in order to reduce power dissipation at the higher voltage level, the resistor 76 is replaced by a resistor 98 having a higher resistance value (preferably 1 kilohm). In addition, the biasing resistor 90 of FIG. 2 is replaced by two higher value resistors 100 and 102 connected in parallel. In this way, the current is split between the two resistors so that resistors having lower power ratings can be used. Finally, the 6-volt lamp of FIG. 2 is replaced by a 12-volt lamp 104 preferably having the same 25-watt power rating.

Figure 4:
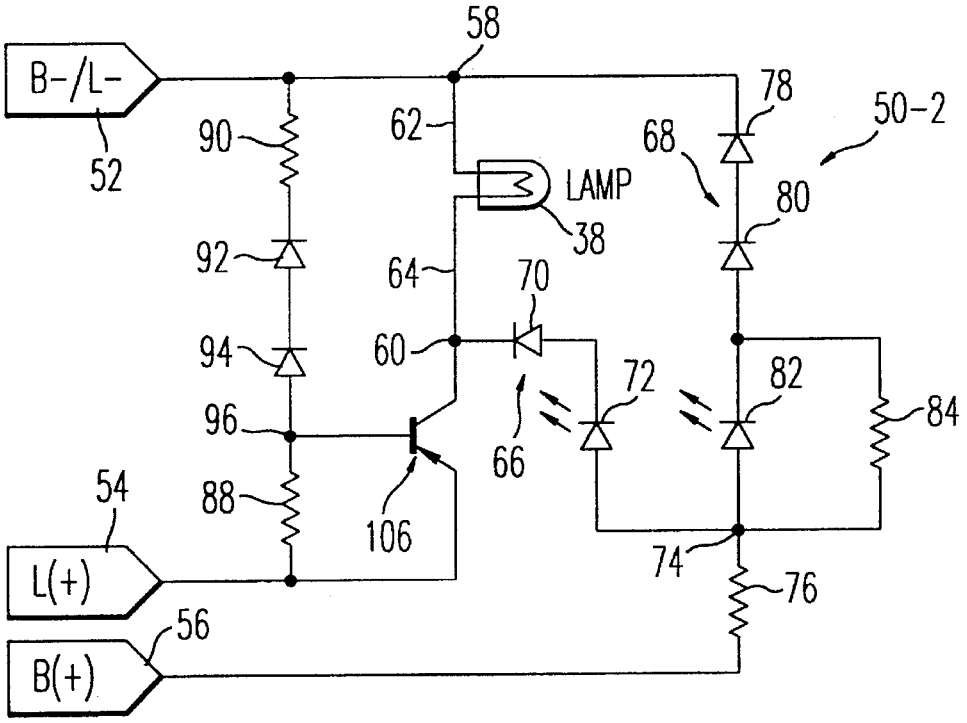
FIGS. 4 and 5 are detailed schematic diagrams of further modifications of the self-diagnostic circuit of FIG. 2, adapted for operation with emergency lighting systems that switch the opposite polarity leg of the battery circuit during the transition from standby mode operation to emergency mode operation.

FIG. 4 illustrates a further modification 50-2 of the self-diagnostic circuit 50 of FIG. 2, adapted for use with an emergency lighting system in which the positive leg (B+) of the battery 20 of FIG. 1 is switched during the transition between standby and emergency operation. The circuit is essentially equivalent to that shown in FIG. 2, except that the polarities of the diodes 70, 78, 80, 92 and 94 and LEDs 72 and 82 are reversed. In addition, the bipolar NPN transistor 86 of FIG. 2 is replaced by a bipolar PNP transistor 106. The operation of the two circuits is substantially the same, except for the directions of voltage drops and current flows.

Figure 5:
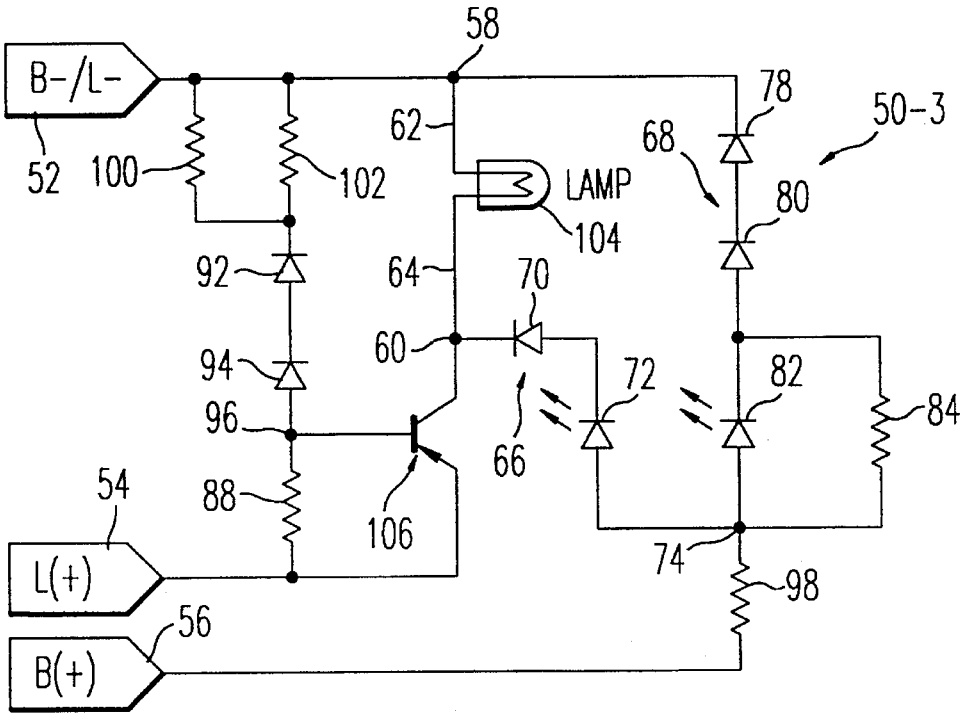

FIG. 5 illustrates a modification 50-3 of the self-diagnostic circuit 50-2 of FIG. 4, which is adapted for 12-volt rather than 6-volt operation. The circuit is equivalent in most respects to that of FIG. 4, except for the substitution of resistors 98, 100 and 102 having values equivalent to those of FIG. 3. In addition, as in the circuit of FIG. 3, a 12-volt lamp 104 is substituted for the 6-volt lamp 38.

Figure 6:
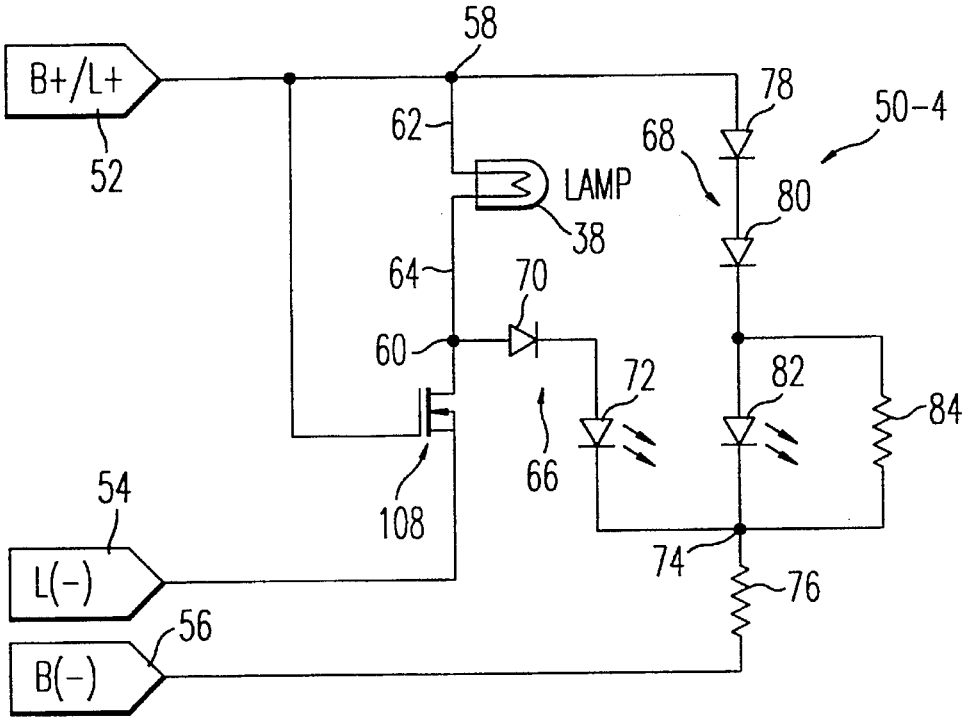
FIGS. 6 and 7 are detailed schematic diagrams of still other modified versions of the self-diagnostic circuit of FIG. 2, employing field effect transistors (FETs) rather than bipolar transistors for lamphead isolation.

FIG. 6 illustrates a still further modification 50-4 of the self-diagnostic circuit 50 of FIG. 2. In this modification, a field effect transistor (FET) 108 is substituted for the bipolar (junction) transistor 86 of FIG. 2, and the resistors 88 and 90 and diodes 92 and 94 are deleted. The FET embodiment is advantageous in that the gate of the FET provides a higher input impedance than the base of a junction transistor, thereby reducing power dissipation and parasitic current losses. Also, since the high input impedance of the FET means that essentially zero current is required to control conduction of the FET, no additional components are required to provide biasing current. This results in a lower component count, lower cost and reduced circuit board area. An N-channel metal-oxide-semiconductor field effect transistor (MOSFET) is illustrated in FIG. 6, but other types of field-effect devices, such as P-channel MOSFETs or Junction field effect transistors (JFETs), may be used in other embodiments.

Figure 7:
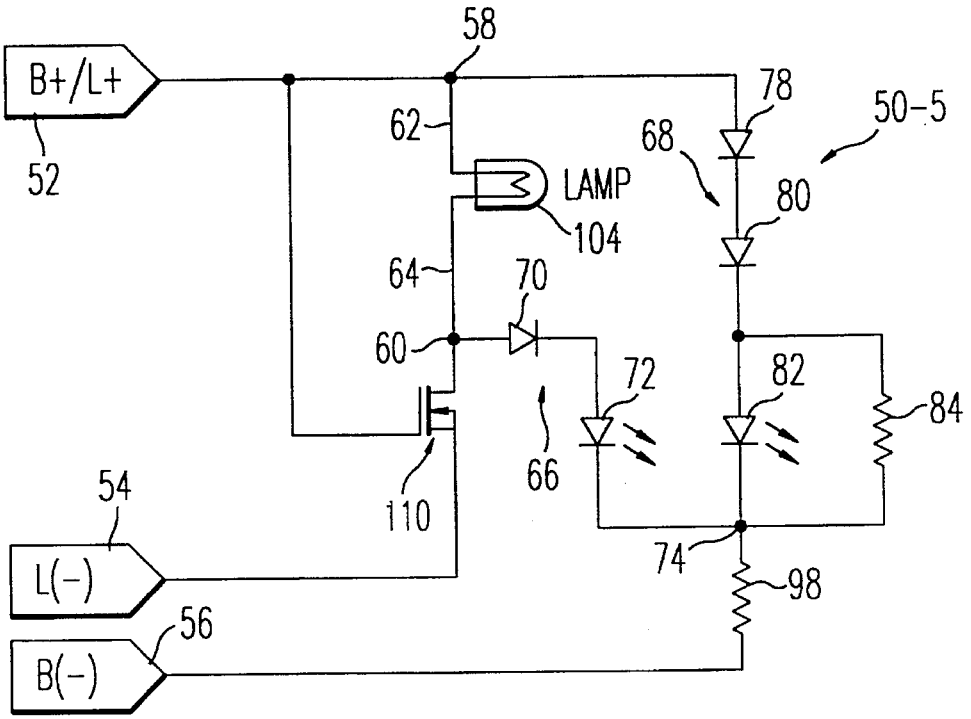

FIG. 7 illustrates a modification 50-5 of the self-diagnostic circuit shown in FIG. 6, which is adapted for 12-volt rather than 6-volt operation. This embodiment is similar to that of FIG. 6, except that the higher value resistor 98 of FIGS. 3 and 5 is substituted for the resistor 76 of FIG. 6, and the 12-volt lamp 104 of FIGS. 3 and 5 is substituted for the 6-volt lamp 38 of FIG. 6. Also, an FET 110 having a gate resistance suited for 12-volt operation is substituted for the 6-volt FET 108 of FIG. 6. It will be appreciated that the self-diagnostic circuits of FIGS. 6 and 7 can be further modified along the lines of FIGS. 4 and 5, for use with emergency lighting systems which switch on the positive side of the battery 20 in FIG. 1. This can be accomplished by substituting a P-channel MOSFET for the N-channel MOSFET 108 of FIG. 7.

Table 1 below is a truth table which summarizes the states of the green and red LEDs 72 and 82 during standby and emergency mode operation. As indicated in Table 1, the green LED is on only during standby operation when proper electrical continuity exists at the lamphead. The red LED is on during standby operation when a lack of electrical continuity is detected in the lamphead, and is always on during emergency operation.

TABLE 1

| Mode | Lamphead | Green LED | Red LED |
|---|---|---|---|
| Standby | Good | On | Off |
| Standby | Bad | Off | On |
| Emergency | Good | Off | On |
| Emergency | Bad | Off | On |

Preferred values for the electrical components used in the self-diagnostic circuits of FIGS. 2–7 are provided in Table 2 below. Resistor values are expressed in ohms (Ω) or kilohms (K). All resistors are ¼-watt unless otherwise noted.

TABLE 2

| Component | Value or Type |
|---|---|
| Lamp 38 | 6 volts, 25 watts max. |
| Diodes 70, 78, 80, 92, 94 | 1N4001 |
| LEDs 72, 82 | 20 milliamps, 2.1 volts |
| Resistor 76 | 390 ohms |
| Resistor 84, 98 | 1K |
| Transistor 86 | MJE3055T with heat sink |
| Resistor 88 | 4.7K |
| Resistor 90 | 22 ohms (2 watts) |
| Resistors 100, 102 | 100 ohms (2 watts) |
| Lamp 104 | 12 volts, 25 watts |
| Transistor 106 | MJE2995T with heat sink |
| FET 108 | Phillips BUK 553-50B or Motorola MTP-3055EL |
| FET 110 | Phillips BUK 453-50B or Motorola MTP-3055E |

The self-diagnostic circuits illustrated in FIGS. 2–7 are advantageous in that they can be used to provide a continuous indication of the operating status of an emergency lamphead during standby mode operation. The self-diagnostic circuits are simple in design and employ only small number of relatively inexpensive components, thereby making it practical to incorporate the circuits into individual remote lampheads in a multiple-lamphead system. The self-diagnostic circuits are compatible with existing types of emergency lamphead systems, including those already incorporating centralized self-testing circuits, and provide suitable isolation when multiple remote lampheads are connected together. The self-diagnostic circuit in each lamphead requires only one additional conductor (corresponding to the third input terminal 56 in FIGS. 2–7) to provide power to the circuit during standby mode operation, and this conductor may have a very small diameter since the current drawn by the self-diagnostic circuit is quite low.

While only a limited number of exemplary embodiments have been chosen to illustrate the present invention, it will be understood by those skilled in the art that various modifications can be made therein. For example, it will be apparent that while the self-diagnostic circuits of the present invention are well-suited to continuous operation, they can be adapted for use in a periodic or intermittent testing mode if desired. Moreover, although the self-diagnostic circuits include bipolar transistors or FETs for isolation purposes, these components (together with the resistors and diodes used for biasing the bipolar transistors) can be deleted if the self-diagnostic circuit is used for only a single lamphead. These and other modifications are intended to fall within the spirit and scope of the invention as defined in the appended claims.

What is claimed is:

1. An emergency lamphead system comprising:

at least one emergency lamphead;

a battery for supplying power to said emergency lamphead during operation in an emergency mode;

a charger for charging said battery during operation in a standby mode;

a transfer switch for switching the output of said battery to said lamphead for operation in said emergency mode; and a self-diagnostic circuit connected to said battery and said lamphead for indicating during standby mode operation whether said lamphead is capable of operating in said emergency mode, said self-diagnostic circuit including a first high-impedance circuit path connected in series with said lamphead, said first high-impedance circuit path having a first indicator which is energized by a first battery current passing through said circuit path and said lamphead during operation in said standby mode, said first battery current being insufficient to illuminate said lamphead.

2. An emergency lamphead system as claimed in claim 1, wherein said self-diagnostic circuit further comprises a second high-impedance circuit path connected in parallel with said lamphead, said second high-impedance circuit having a second indicator which is energized by a second battery current passing through said second high-impedance circuit path to indicate that said emergency lamphead is not capable of operating in said emergency mode, the flow of said second battery current being disabled in response to the flow of said first battery current in said first high-impedance circuit path so that said second indicator is de-energized whenever said first indicator is energized.

3. An emergency lamphead system as claimed in claim 2, wherein said first and second high-impedance circuit paths each comprise one or a plurality of series-connected junction diodes connected in series with a common impedance element shared by said first and second high-impedance circuit paths, the total number of junction diodes in said second high-impedance circuit path being at least one greater than the total number of junction diodes in said first high-impedance circuit path so that the aggregate diode voltage drop is greater in said second high-impedance circuit path than in said first high-impedance circuit path.

4. An emergency lamphead system as claimed in claim 3, wherein said impedance element comprises a resistor having a resistance value much greater than the resistance of said emergency lamphead.

5. An emergency lamphead system as claimed in claim 3, wherein said first and second indicators comprise light-emitting diodes.

6. An emergency lamphead system as claimed in claim 5, further comprising a bypass resistor connected in parallel across the light-emitting diode of said second high-impedance circuit path.

7. An emergency lamphead system as claimed in claim 1, wherein said self-diagnostic circuit further comprises a controlled switching device connected in series with said lamphead for controlling the flow of current through said lamphead, said controlled switching device being rendered conductive in response to battery voltage being applied to said self-diagnostic circuit by said transfer switch during operation in said emergency mode, and being rendered nonconductive in response to battery voltage being removed from said self-diagnostic circuit by said transfer switch during operation in said standby mode.

8. An emergency lamphead system as claimed in claim 7, wherein said controlled switching device comprises a bipolar transistor.

9. An emergency lamphead system as claimed in claim 7, wherein said controlled switching device comprises a field effect transistor.

10. A self-diagnostic circuit for use with an emergency lamphead system including at least one emergency lamphead, a battery for supplying power to said emergency lamphead in an emergency mode, a charger for charging said battery in a standby mode, and a transfer switch for switching one polarity output of said battery to said lamphead in said emergency mode, said self-diagnostic circuit comprising:

a first input terminal adapted to be connected to a first polarity output of said battery;

a second input terminal adapted to be connected to a second polarity output of said battery through said transfer switch;

a third input terminal adapted to be connected to the second polarity output of said battery without passing through said transfer switch;

first and second output terminals adapted to be connected to the power terminals of said emergency lamphead, said first output terminal being coupled to said first input terminal;

a controlled switching device coupled between said second output terminal and said second input terminal, said controlled switching device being rendered conductive to energize said output terminals in response to battery voltage being applied between said first and second input terminals by said transfer switch in said emergency mode, and said controlled switching device being rendered nonconductive to de-energize said output terminals in response to said battery voltage being removed from said second input terminal by said transfer switch in said standby mode;

a first high-impedance circuit path extending between said second output terminal and said third input terminal, said first high-impedance circuit path including a first indicator which is energized by a battery current passing through said first high-impedance circuit path and said emergency lamphead in said standby mode to indicate that said emergency lamphead is capable of operating, the impedance of said first high-impedance circuit path being high enough so that said battery current is insufficient to illuminate said emergency lamphead in said standby mode.

11. A self-diagnostic circuit as claimed in claim 10, further comprising a second high-impedance circuit path extending between said first input terminal and said third input terminal, said second high-impedance circuit path including a second indicator which is energized by a second battery current passing through said second high-impedance circuit path to indicate that said emergency lamphead is not capable of operating, the flow of said second battery current being disabled by the flow of said first battery current in said first high-impedance circuit path so that said second indicator is de-energized whenever said first indicator is energized.

12. A self-diagnostic circuit as claimed in claim 11, wherein said first high-impedance circuit path comprises at least one junction diode which is forward-biased in one direction between said first input terminal and said third input terminal, and said second high-impedance circuit path comprises at least two series-connected junction diodes which are forward-biased in said direction, the total number of junction diodes in said second high-impedance circuit path being at least one greater than the total number of junction diodes in said first high-impedance circuit path so that the aggregate diode voltage drop is greater in said second high-impedance circuit path than in said first high-impedance circuit path, and the terminals of the junction diodes nearest to the third terminal in said first and second high-impedance circuit paths being connected to a common node, said first and second high-impedance circuit paths further comprising a shared impedance element connected between said common node and said third input terminal.

13. A self-diagnostic circuit as claimed in claim 12, wherein said impedance element comprises a resistor having a resistance value much greater than the resistance of said emergency lamphead.

14. A self-diagnostic circuit as claimed in claim 12, wherein said first and second indicators comprise light-emitting diodes.

15. A self-diagnostic circuit as claimed in claim 14, further comprising a bypass resistor connected in parallel across the light-emitting diode of said second high-impedance circuit path.

16. A self-diagnostic circuit as claimed in claim 10, wherein said controlled switching device comprises a bipolar transistor.

17. A self-diagnostic circuit as claimed in claim 10, wherein said controlled switching device comprises a field effect transistor.

18. A method for monitoring the operational status of an emergency lamphead, comprising the steps of:

placing the lamphead in series with a first indicator circuit which produces an output in response to a flow of current through said first indicator circuit;

applying a voltage across the series combination of said lamphead and said first indicator circuit to produce a flow of current through said first indicator circuit when electrical continuity exists through said lamphead; and limiting said current to a value sufficient to produce an output from said first indicator circuit but insufficient to illuminate said lamphead.

19. A method as claimed in claim 18, further comprising the steps of:

placing a second indicator circuit in parallel across the series combination of said lamphead and said first indicator circuit, said second indicator circuit producing an output in response to a flow of current through said second indicator circuit; and in the absence of electrical continuity through said lamphead, causing current to flow through said second indicator circuit as a result of said applied voltage to produce an output from said second indicator circuit.

20. A method as claimed in claim 18, further comprising the steps of:

applying a voltage across said lamphead to illuminate said lamphead during an emergency mode of operation;

disabling the operation of said first indicator circuit during said emergency mode of operation.

* * * * *